United States Patent [19]

Peterson

[11] 4,045,761

[45] Aug. 30, 1977

[54] MOUNTING BRACKET FOR A HEAT DETECTOR SWITCH

[75] Inventor: Reuben E. Peterson, Fergus Falls, Minn.

[73] Assignee: Jenoff, Incorporated, Fergus Falls, Minn.

[21] Appl. No.: 656,353

[22] Filed: Feb. 9, 1976

[51] Int. Cl.[2] ..... H01H 37/04; H01H 37/56

[52] U.S. Cl. ..... 337/372; 310/68 C

[58] Field of Search ..... 337/414, 372–380; 310/68 C

[56] References Cited

U.S. PATENT DOCUMENTS

| | | | |
|---|---|---|---|
| 1,331,038 | 2/1920 | Woodbury | 337/380 |
| 2,357,533 | 9/1944 | Meza | 337/372 |
| 2,717,945 | 9/1955 | Dresios et al. | 310/68 C |
| 3,875,439 | 4/1975 | Roach | 310/68 C |

*Primary Examiner*—Harold Broome

*Attorney, Agent, or Firm*—Zarley, McKee, Thomte & Voorhees

[57] ABSTRACT

A mounting bracket for a heat detector switch which not only provides a convenient means for mounting the switch on a bearing or motor but which also prevents the heat detector switch from being damaged while thereon. The bracket comprises a flat plate having a hollow tubular member mounted on the top surface of the plate member at one end thereof. A heat detector switch is mounted on the top surface of the plate adjacent the other end thereof and is electrically connected to an electrical wire which extends through the tubular member. A protective shield extends over the heat detector switch. The interior of the tubular member and the protective member are filled with a silicone rubber material. The heat detector switch is activated upon the motor or bearing reaching a predetermined temperature to activate a signal device electrically connected to the electrical wire in the tubular member.

5 Claims, 7 Drawing Figures

MOUNTING BRACKET FOR A HEAT DETECTOR SWITCH

BACKGROUND OF THE INVENTION

This invention relates to a heat detector switch and more particularly to a mounting bracket for a heat detector switch.

Heat detectors have been employed on bearings, motors, etc. to provide a warning if and when the motor or bearing becomes overheated. Heat detectors are generally shown in U.S. Pat. Nos. 2,119,184; 2,164,674; 2,596,847 and 2,709,210. While the devices of the prior art may have been generally satisfactory, the devices were difficult to mount on the associated structure and required extensive modification thereof. Further, the devices disclosed in the prior art are subject to damage upon being struck by a tool, broom, etc.

Therefore, it is a principle object of the invention to provide a mounting bracket for a heat detector switch.

A further object of the invention is to provide a mounting bracket for a heat detector switch which includes protective means for the switch for preventing damage to the switch.

A further object of the invention is to provide a mounting bracket for a heat detector switch which includes an off-set bracket member to permit the assembly to be connected to the motor or bearing in limited space situations.

A still further object of the invention is to provide a mounting bracket for a heat detector switch which may be applied to the motor or bearing without extensive modification thereof.

A still further object of the invention is to provide a mounting bracket for a heat detector switch which is economical to manufacture, durable in use and refined in appearance.

DESCRIPTION OF THE PREFERRED EMBODIMENT

Figure 1:
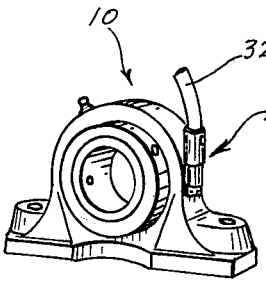
FIG. 1 is a view illustrating the heat detector switch and bracket of this invention mounted on a bearing.
Figure 2:
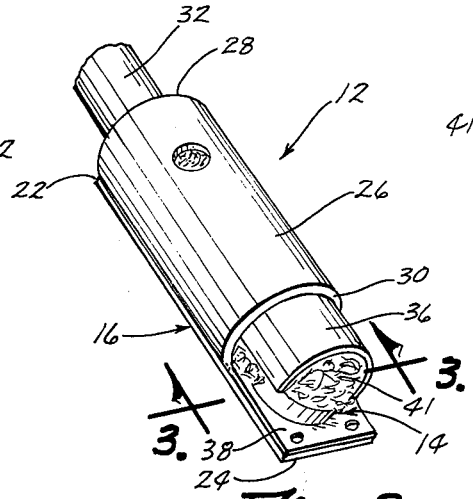
FIG. 2 is a front perspective view of the device of this invention.
Figure 3:
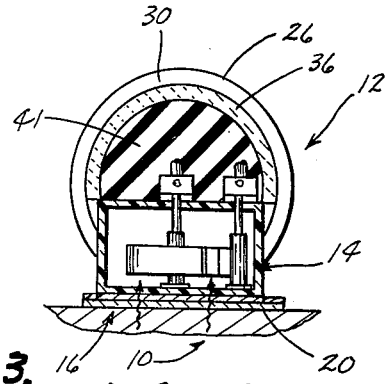
FIG. 3 is a sectional view seen on lines 3—3 of FIG. 2.
Figure 4:
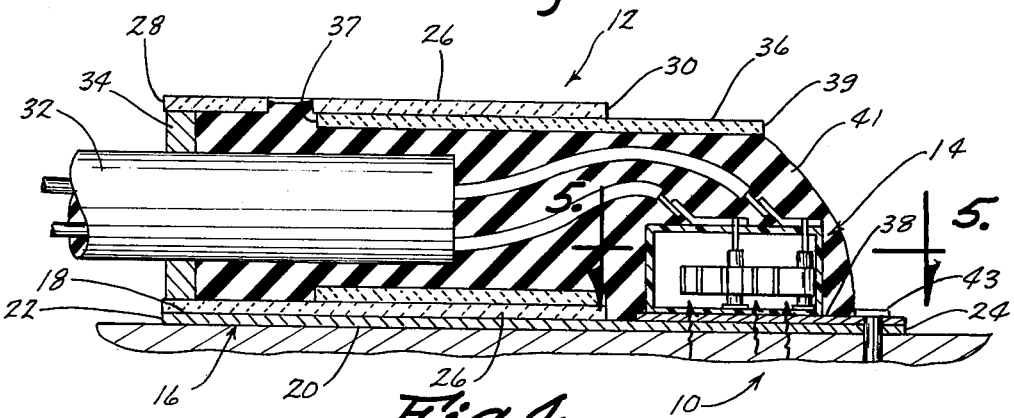
FIG. 4 is a partial longitudinal sectional view of the device.

Referring now to the drawings, the numeral 10 refers generally to a conventional pillow bearing while the numeral 12 refers generally to the mounting bracket of this invention having the heat detector switch or heat sensing means 14 mounted therein.

Bracket 12 generally comprises a flat metal plate 16 having a top surface 18, bottom surface 20 and opposite ends 22 and 24. A tubular member, such as a metal pipe 26 or the like, is welded, soldered or otherwise secured to the top surface of plate 16. Pipe includes ends 28 and 30. As seen in the drawings, end 30 of pipe 26 is spaced from end 24 of plate 16.

The numeral 32 refers to an electrical wire which extends inwardly into pipe 26 from end 28. A rubber grommet embraces wire 32 within end 28 of pipe 26 to seal and secure the wire 32 within pipe 26. The numeral 36 refers to a semi-circular shield comprised of plastic material. Shield 36 includes ends 37 and 39. Shield 36 is received by end 30 of pipe 26 and extends outwardly therefrom as seen in the drawings. The switch 14 is provided with a plate 38 secured to the bottom surface thereof which has a pair of holes or openings 40 and 42 formed therein in the outer end thereof. The two leads of wire 32 are electrically connected to the terminals of the switch 14 by solder or the like. The cavity within pipe 26 and the area below shield 36 is completely filled with a silicone rubber material or other suitable material so that the switch 14 is embedded therein. The silicone rubber material is generally indicated at 41.

The device is secured to the bearing 10 by drilling a pair of openings 40 and 42 formed in plate 38. It should be noted that plate 16 also has a pair of openings formed therein which register with the openings 40 and 42. A pair of drive nails or rivets are extended through the openings 40 and 42 respectively and the openings in plate 16 and are received by the pair of openings formed in the bearing 10 to securely attach the device to the bearing.

In use, if bearing 10 becomes overheated, the heat will be transferred through the metal plate 16 which is comprised of a heat conductive material such as copper or the like, so that the normally open conventional switch 14 will be closed thereby activating the signal means 44 which may be either a light or audio alarm. The activation of the signal means 44 will indicate that the bearing is overheating and that remedial measures should be taken immediately.

The method of attaching the bracket to the motor securely mounts the switch assembly and the housing itself to the bearing assembly. The protective shield 36 and the silicone rubber material 41 positioned over the switch insures that the switch will not be damaged if someone steps on or otherwise disturbs the switch. The protective shield and the silicone rubber material also prevents damage to the switch during cleaning operations of the bearing such as could occur if an unprotective switch were struck by a broom or the like.

Figure 6:
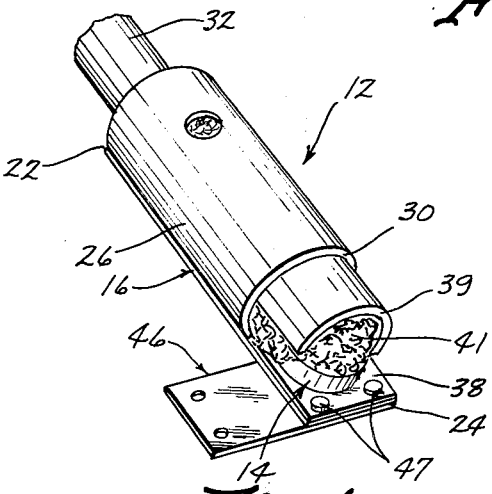
FIG. 6 is a perspective view of the modified form of the device.
Figure 5:
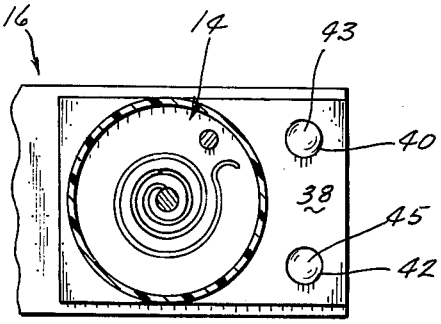
FIG. 5 is a sectional view seen on lines 5—5 of FIG. 4.
Figure 7:
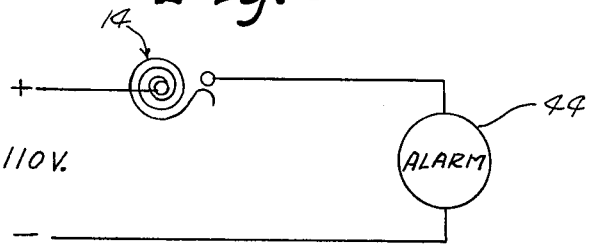
FIG. 7 is a typical schematic of the circuitry of the device.

FIG. 6 illustrates a modified form of the device and is generally similar to the bracket 12 in FIGS. 1–4 except that an off-set bracket 46 is secured to the underside of plate 16 and extends laterally therefrom. The off-set bracket 46 would be secured to the housing of the bearing or motor by drive nails or rivets and would be used where space would not permit the basic bracket assembly to be directly applied to the bearing. As seen in the drawings, the bracket 46 is secured to plate 16 by small bolts 47.

Thus it can be seen that a mounting bracket has been provided for a heat detector switch which is secured to a motor, bearing or other mass. If the motor, bearing or mass becomes overheated, the heat therefrom is transferred through the mounting bracket to the heat sensing means so that an alarm is activated to warn of the overheating situation. The mounting bracket of this invention provides a convenient means for mounting the switch on a member requiring heat monitoring and the construction of the mounting bracket is such that the switch will not be damaged during the use thereof.

Thus it can be seen that the invention accomplishes at least all of the stated objectives.

I claim:

1. In combination with a member requiring heat monitoring, comprising, a first flat plate member having top and bottom surfaces and first and second ends, a hollow tubular member mounted on the top surface of said first plate member, said tubular member having first and second ends, a heat sensing means mounted on said first flat plate member adjacent said second end thereof, an electrical wire means extending through said tubular member from said first end thereof and being electrically connected to said heat sensing means, protective means extending over said heat sensing means for preventing damage thereto, said first flat plate member being heat conductive, means operatively mounting said first flat plate member to the member requiring heat monitoring, said electrical wire means adapted to be operatively connected to a signal means which is activated by said heat sensing means when the member requiring heat monitoring reaches a predetermined temperature which is transmitted through said first plate member to said heat sensing means, said heat sensing means having a second flat plate member mounted on the bottom thereof, said second flat plate member having at least one opening formed therein, said first flat plate member having at least one opening formed therein which registers with the opening in said second flat plate member, said mounting means comprising a connector means extending through the openings in said first and second plate members.

2. In combination with a member requiring heat monitoring, comprising, a first flat plate member having top and bottom surfaces and first and second ends, a hollow tubular member mounted on the top surface of said first plate member, said tubular member having first and second ends, a heat sensing means mounted on said first flat plate member adjacent said second end thereof, an electrical wire means extending through said tubular member from said first end thereof and being electrically connected to said heat sensing means, protective means extending over said heat sensing means for preventing damage thereto, said first flat plate member being heat conductive, means operatively mounting said first flat plate member to the member requiring heat monitoring, said electrical wire means adapted to be operatively connected to a signal means which is activated by said heat sensing means when the member requiring heat monitoring reaches a predetermined temperature which is transmitted through said first plate member to said heat sensing means, an off-set plate member secured to said first plate member at the said second end thereof and which extends laterally therefrom, said mounting means comprising a connector means extending through said off-set plate member.

3. In combination with a member requiring heat monitoring, comprising, a first flat plate member having top and bottom surfaces and first and second ends, a hollow tubular member mounted on the top surface of said first plate member, said tubular member having first and second ends, said second end of said tubular member being spaced from said second end of said first plate member, a heat sensing means mounted on said first flat plate member adjacent said second end thereof outwardly of said second end of said tubular member, an electrical wire means extending through said tubular member from said first end thereof and being electrically connected to said heat sensing means, a substantially rigid shield means secured to said tubular member and extending therefrom over said heat sensing means for preventing damage thereto, said first flat plate member being heat conductive, means operatively mounting said first flat plate member to the member requiring heat monitoring, said electrical wire means adapted to be operatively connected to a signal means which is activated by said heat sensing means when the member requiring heat monitoring reaches a predetermined temperature which is transmitted through said first plate member to said heat sensing means.

4. The combination of claim 3 wherein a resilient material is positioned within said tubular member and between said shield means and said heat sensing means.

5. The combination of claim 3 wherein said shield member has a semi-circular cross section.

* * * * *